US005694828A

United States Patent [19]

Umemura et al.

[11] Patent Number: 5,694,828

[45] Date of Patent: Dec. 9, 1997

[54] CAM PLATE TYPE COMPRESSOR

[75] Inventors: Satoshi Umemura; Hayato Ikeda; Hideo Mori; Hirofumi Sato; Norikazu Deto; Hisato Kawamura; Hiromi Michiyuki; Tomoji Tarutani, all of Kariya, Japan

[73] Assignee: Kabushiki Kaisha Toyoda Jidoshokki Seisakusho, Kariya, Japan

[21] Appl. No.: 527,369

[22] Filed: Sep. 12, 1995

[30] Foreign Application Priority Data

Sep. 13, 1994 [JP] Japan ..... 6-219175
Jul. 25, 1995 [JP] Japan ..... 7-189588

[51] Int. Cl.[6] ..... F01B 3/00

[52] U.S. Cl. ..... 92/71; 417/269

[58] Field of Search ..... 92/12.2, 71; 91/499, 91/501; 417/269; 74/60

[56] References Cited

U.S. PATENT DOCUMENTS

| | | | |
|---|---|---|---|
| 1,714,145 | 5/1929 | Sperry | 417/269 |
| 2,839,008 | 6/1958 | Stansfield et al. | 417/269 |
| 3,817,660 | 6/1974 | Knowles et al. | 92/71 |
| 4,392,416 | 7/1983 | Ishizuka | 92/71 |
| 4,790,727 | 12/1988 | Steele . | |
| 5,013,219 | 5/1991 | Hicks et al. | 417/269 |

FOREIGN PATENT DOCUMENTS

| | | |
|---|---|---|
| 4213249 | 10/1992 | Germany . |
| 6241162 | 8/1994 | Japan . |

OTHER PUBLICATIONS

Niemann, G., "Maschinenelemente, 2. Aufl. Band 1", published 1975, pp. 302–320.

*Primary Examiner*—Thomas E. Denion
*Attorney, Agent, or Firm*—Brooks Haidt Haffner & Delahunty

[57] ABSTRACT

Disclosed is a compressor designed to facilitate the assembling of the thrust bearing and reduce noise. A swash plate which moves in responsive to the drive shaft is arranged in a crank chamber defined in a pair of cylinder blocks. Ring washers are held between both bosses of the swash plate and seats formed on both cylinder blocks. Wedge-like clearances are formed between the washers and the seats of the cylinder blocks for the effective introduction of the refrigerant gas by the yawing of the swash plate which occurs as the compressor runs. At this time, the washers, together with the lubrication oil mist contained in the refrigerant gas, constitute the dynamic bearing to support the swash plate and permit the relative movement of the swash plate to the cylinder blocks.

20 Claims, 11 Drawing Sheets

CAM PLATE TYPE COMPRESSOR

BACKGROUND OF THE INVENTION

1. Field of the Invention

The present invention relates to a cam plate type compressor. More particularly, this invention relates to a cam plate type compressor including a swash plate type compressor equipped with double-headed pistons.

2. Description of the Related Art

In a compressor having a cam plate, such as a swash plate, mounted on a rotary shaft, the rotation of the rotary shaft is converted to the linear movement of pistons via the cam plate. Each piston reciprocates in its associated cylinder bore to compress the gas. This compression causes the radial load and thrust load acting on the shaft. Accordingly, the rotary shaft is supported by the radial bearing and thrust bearing.

Japanese Unexamined Patent Publication No. Hei 1-134085 discloses the compressor including double-headed pistons which reciprocate based on the rotation of the swash plate. As shown in FIG. 21, the thrust bearing comprises an inner race 101, which comes in slide contact with the boss 100*a* of a swash plate 100 as the cam plate, an outer race 103 held in slidable contact with a cylinder block 102, and a cylindrical roller 104 rollable held between both races 101 and 103. The inner race 101 rotates in synchronism with the rotation of the swash plate 100, and the roller 104 rotates around its own axis and makes a predetermined orbital movement. This rotation is transmitted to the outer race 103, causing the race 103 and cylinder block 102 to slide with each other. The thrust bearing comprising the inner race 101, outer race 103 and roller 104, permits the relative rotation of the swash plate 100 with respect to the cylinder block 102.

In general, as described above, the roll bearing like the roller 104 supporting the load via a rolling body has been often employed as the support structure for the thrust load in a cam plate type compressor with double-headed pistons. The thrust bearing thus structured not only suffers an increase in the number of parts but also results in the complication of the assembling steps and the increased number of steps. Further, it is not unlikely to erroneously assemble the outer race 103 and the inner race 101 in the compressor, the former mistaken for the latter. It is therefore necessary to provide sensors in the production line to detect assembling errors, requiring a considerable cost for the production facility.

When the compressor is in operation, the compressing action of the pistons causes the reaction force to act on the swash plate 100, thus causing slight yawing thereof with respect to the cylinder block 102. Because the yawing of the swash plate 100 causes for vibration in the compressor, the cylinder block 102 holds the swash plate 100 with force preset large enough to reduce the vibration. With the use of the roll bearing having the cylindrical roller 104, however, if the force is set large, an excessive resistance is imparted to the rolling of the roller 104 between two races 101 and 103. This rolling resistance together with the difference in the rolling speed of the roller 104 according to the radial position of the swash plate 100 generates noise.

SUMMARY OF THE INVENTION

Accordingly, it is a primary objective of the present invention to provide a compressor easily manufactured.

It is another objective of this invention to provide a compressor capable of reducing the cost of the production facility.

It is a further objective of this invention to provide a compressor capable of suppressing noise generated during operation.

To achieve the above objects, this invention has improved a compressor which has a cam plate attached on a rotary shaft in a crank chamber and permits the cam plate to convert the rotation of the rotary shaft to the reciprocal movement of double-headed pistons in cylinder bores formed in each cylinder block facing the sides of the cam plate to thereby compress gas. Bosses are formed in both sides of the cam plate. A seat functioning as a pressure-receiving portion is formed at the outer periphery of each cylinder bore in such a way as to face the bosses. To receive the thrust load acting on the rotary shaft, a ring-like washer is held between each boss and the pressure-receiving portion.

Gas contains oil mist for lubricating the parts of the compressor. In a preferable embodiment, means for forming an oil film between the bosses and seats by the lubrication oil contained in the gas is formed on at least one of the bosses and pressure-receiving portions. This oil film serves as a dynamic thrust bearing of the rotary shaft.

DETAILED DESCRIPTION OF THE PREFERRED EMBODIMENTS

The first embodiment of the present invention will be now described with reference to FIGS. 1 through 4.

Figure 1:
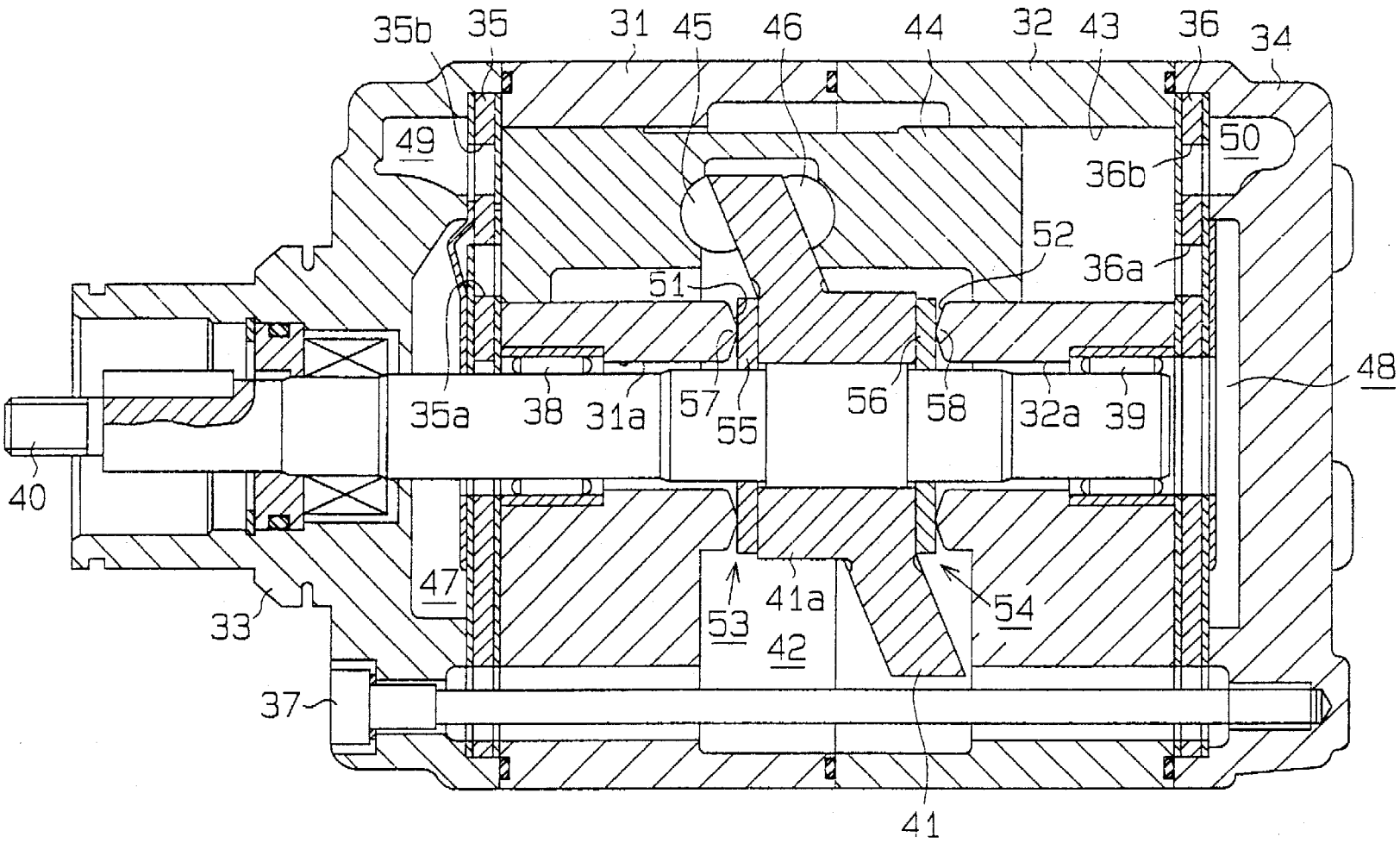
FIG. 1 is a cross-sectional view showing the overall compressor according to a first embodiment of this invention.

As shown in FIG. 1, a front cylinder block 31 and a rear cylinder block 32 are coupled to each other. A front housing 33 is connected to the outer end of the cylinder block 31 via a valve plate 35, and a rear housing 34 is connected to the outer end of the cylinder block 32 by way of a valve plate 36. The cylinder blocks 31 and 32, the valve plates 35 and 36, the front housing 33 and the rear housing 34 are securely fastened by bolts 37.

A drive shaft 40 is rotatably supported via radial bearings 38 and 39 in center holes 31*a* and 32*a* of the cylinder blocks 31 and 32 between both cylinder blocks 31 and 32. A swash plate 41 is secured to the drive shaft 40 via bosses 41*a* of the swash plate 41, and is supported in a crank chamber 42 formed by the connection of the cylinder blocks 31 and 32 in such a way as to be rotatable together with the drive shaft 40.

Pairs of front and rear cylinder bores 43 are formed in the cylinder blocks 31 and 32 at equal angular distances around the drive shaft 40. Double-headed pistons 44 are reciprocatably fitted in the associated pairs of front and rear cylinder bores 43, with hemispherical shoes 45 and 46 intervening between each piston 44 and the front and rear sides of the swash plate 41. The rotation of the swash plate 41 is converted to the reciprocal movement of the pistons 44 in the associated cylinder bores 43 via the shoes 45 and 46.

Discharge chambers 47 and 48 are formed in the respective housings 33 and 34 in such a way as to include approximately the center portions thereof. Annular suction chambers 49 and 50 surrounding the discharge chambers 47 and 48 are formed at the outer peripheral portions of the housings 33 and 34. The discharge chambers 47 and 48 communicate with the cylinder bores 43 via discharge ports 35*a* and 36*a* bored through the valve plates 35 and 36, and the suction chambers 49 and 50 communicate with the cylinder bores 43 via suction ports 35*b* and 36*b* also bored through the valve plates 35 and 36.

Formed in each of the cylinder blocks 31 and 32 are a plurality of passages (not shown) running over the entire cylinder block in its lengthwise direction. Those passages permit the communication between the discharge chambers 47 and 48 and the communication between the suction chambers 49 and 50. The crank chamber 42 is connected to the passages (not shown) which connect the both suction chambers 49 and 50 to each other.

Figure 2:
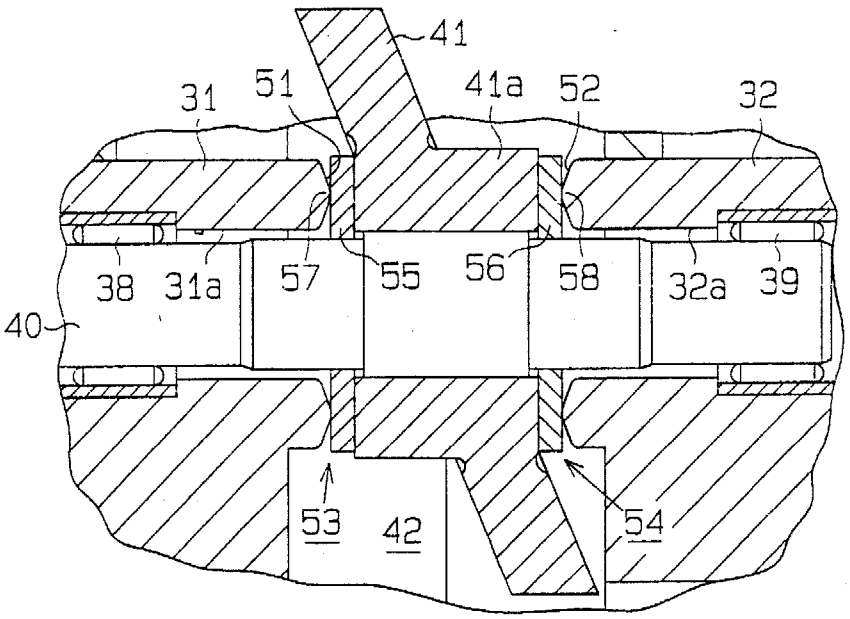
FIG. 2 is a cross-sectional view showing the thrust bearing mechanism of the rotary shaft in the compressor shown in FIG. 1.

Thrust bearings 53 and 54 are held between the bosses 41*a* of the swash plate 41 and seats 51 and 52 of the cylinder blocks 31 and 32. The thrust load acting on the drive shaft 40 is received by the cylinder blocks 31 and 32 via the thrust bearings 53 and 54. The feature of this invention lies in that the thrust bearings 53 and 54 are constituted by simply intervening ring washers 55 and 56 between the bosses 41*a* and the seats 51 and 52. As shown in FIG. 2, the seats 51 and 52 having annular projections 57 and 58 are formed at the cylinder blocks 31 and 32, with approximately equal inner and outer wedge-like clearances normally formed with respect to the washers 55 and 56. Each of the bosses 41*a* facing the seats 51 and 52 has a flat shape corresponding to the whole one side of the associated one of the washers 55 and 56. The washers 55 and 56 are made of iron-based metal having greater rigidity than the cylinder blocks 31 and 32 and the swash plate 41 (bosses 41*a*), which are made of aluminum-based metal.

It is desirable that the annular projections 57 and 58 depicted in this specification be formed in the order of several microns to several tens of microns.

The action of the thus constituted cam plate type compressor with double-headed pistons will be discussed below.

When the drive shaft 40 rotates, the swash plate 41 rotates and the pistons 44 responsive to the action of the swash plate 41 via the shoes 45 and 46 reciprocate in the associated cylinder bores 43. In the suction stroke in which each piston 44 returns from the top dead center to the bottom dead center, the refrigerant gas in the suction chambers 49 and 50 is taken into the cylinder bores 43 via the suction ports 35*b* and 36*b*. In the compression stroke in which each piston 44 moves to the top dead center from the bottom dead center, the gas in the cylinder bores 43 is compressed. When the pressure of the refrigerant gas reaches a predetermined level, the compressed gas is discharged to the associated discharge chamber 47 or 48 from the discharge port 35*a* or 36*a*. At this time, the washers 55 and 56 rotate mainly together with the bosses 41*a* in accordance with the rotation of the swash plate 41. Accordingly, sliding occurs remarkably between the washers 55 and 56 and the associated cylinder blocks 31 and 32.

Figure 3:
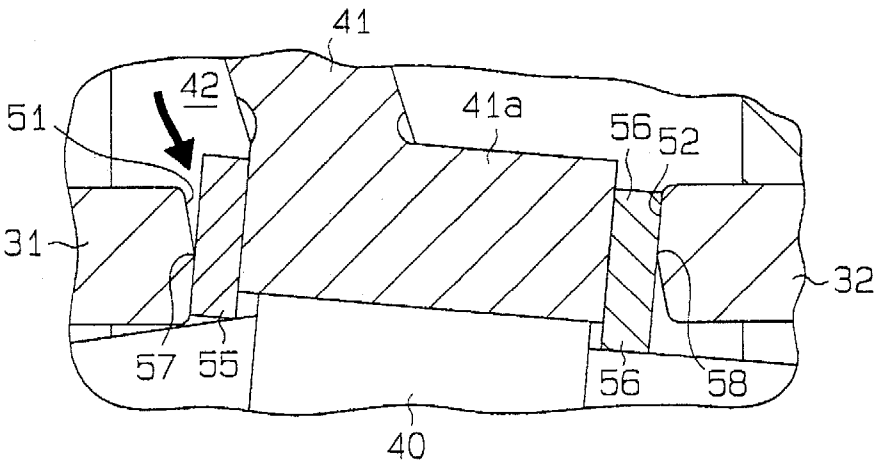
FIG. 3 is a cross-sectional view illustrating the operational principle for supplying a refrigerant gas containing a oil mist toward one washer shown in FIG. 2.
Figure 4:
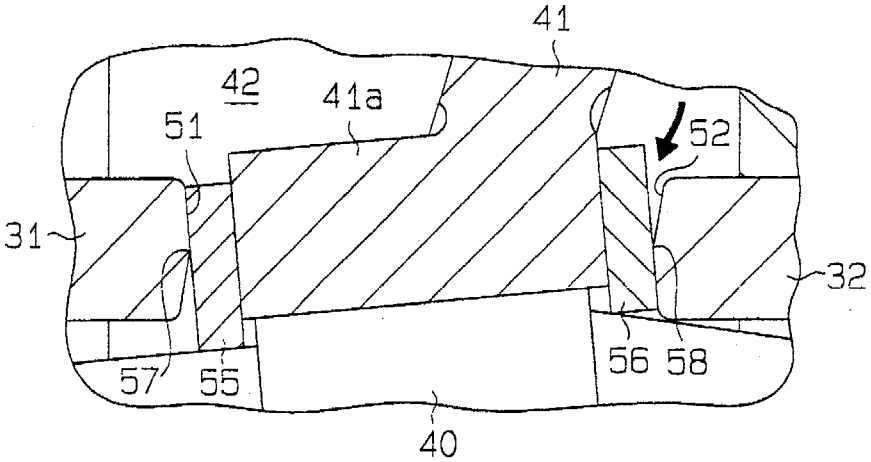
FIG. 4 is a cross-sectional view illustrating the operational principle for supplying the gas toward the other washer.

When the suction, compression and discharge of the gas are executed in the above manner, the compressive reaction force produced by the refrigerant gas acts on the swash plate 41. Because the moment based on this compressive reaction force bends the drive shaft 40, the swash plate 41 yaws with respect to the cylinder blocks 31 and 32. As described earlier, the washers 55 and 56 rotate approximately in synchronism with the bosses 41*a*. Therefore, the washers 55 and 56 also follow up the moment-oriented yawing of the swash plate 41. As shown in FIGS. 3 and 4, the yawing of the swash plate 41 forms the wedge-like clearances between the pressure-receiving portions 51 and 52 and the associated washers 55 and 56 to draw the refrigerant gas, together with the inclination of the annular projections 57 and 58 formed at the pressure-receiving portions 51 and 52, every time the drive shaft 40 makes one turn. It should be noted that FIGS. 3 and 4 overemphasize the bending of the drive shaft 40, the yawing of the swash plate 41 and the inclination of the washers 55 and 56 responsive to that yawing for the purpose of better understanding.

The wedge-like clearance which is open to the crank chamber 42 nearly forces the gas to be properly supplied from the crank chamber 42 as indicated by the arrows in FIGS. 3 and 4. As a result, the washers 55 and 56 and the clearances which are filled with the oil mist contained in the gas to form the dynamic bearing. The moment load from the bosses 41*a* acting on the cylinder blocks 31 and 32 are properly absorbed by the dynamic bearing, formed by the washers 55 and 56 and the oil films, and smoothens the relative motion of the swash plate 41 with respect to the cylinder blocks 31 and 32.

Since the discharge pressure is higher than the suction pressure, the cylinder blocks 31 and 32 elastically deform inwardly due to the action of the compressed gases in the discharge chambers 47 and 48. This elastic deformation causes the swash plate 41 to be firmly held via the washers 55 and 56 and the oil films, thereby effectively preventing the vibration of the swash plate 41 from being caused by the reaction force.

According to this embodiment, the utilization of the moment originated from the reaction force effectively supplies the oil mist to the clearances between the washers 55 and 56 and the associated seats 51 and 52, thus constructing the dynamic bearing. It is therefore possible to obtain the same bearing effect as given by the conventional roll bearing by simply intervening the washers 55 and 56 between the cylinder blocks 31 and 32 and the swash plate 41, thereby accomplishing the reduction in the number of necessary parts.

As the washers 55 and 56 are held by the seats 51 and 52 and the bosses 41*a*, the supporting rigidity for the swash plate 41 is greater than the one provided by the conventional structure with the deformed thrust bearing, thereby suppressing the yawing of the swash plate 41.

The use of the dynamic bearing increases the force between the cylinder blocks 31 and 32 supporting the swash plate 41, thereby effectively suppressing the vibration of the compressor originated from the yawing of the swash plate 41.

Further, the formation of the annular ribs 57 and 58 at the seats 51 and 52 brings about the squeezing effect to prevent the contact between the washers 55 and 56 and the associated seats 51 and 52. Even if the holding force between the cylinder blocks 31 and 32 that support the swash plate 41 is increased, therefore, thick lubrication oil films can be easily formed between the washers 55 and 56 and the associated seats 51 and 52. The "squeezing effect" is the performance of the force of the oil present between two adjoining surfaces to prevent both surfaces from directly contacting each other, and this force becomes greater as the distance between both surfaces becomes smaller.

When the compressor is running at a low speed, the refrigerant gas is drawn into the cylinder bores 43 in the suction stroke, providing relatively large compressive reaction force acting on the pistons 44. Further, the force of inertia of the pistons 44 is small so that the excessive moment load from the bosses 41*a* acts on the cylinder blocks 31 and 32. However, the compressed gas in the discharge chambers 47 and 48 formed in both housings 33 and 34 in such a way as to include approximately the center portions thereof elastically deforms the cylinder blocks 31 and 32, thereby effectively supporting the swash plate 41 via the thrust bearing that is formed by the washers 55 and 56 and the oil films. It is therefore possible to reduce noise originated from the vibration of the swash plate 41 by using the high-pressure gases in the discharge chambers 47 and 48 when the compressor is in operation.

Figure 5:
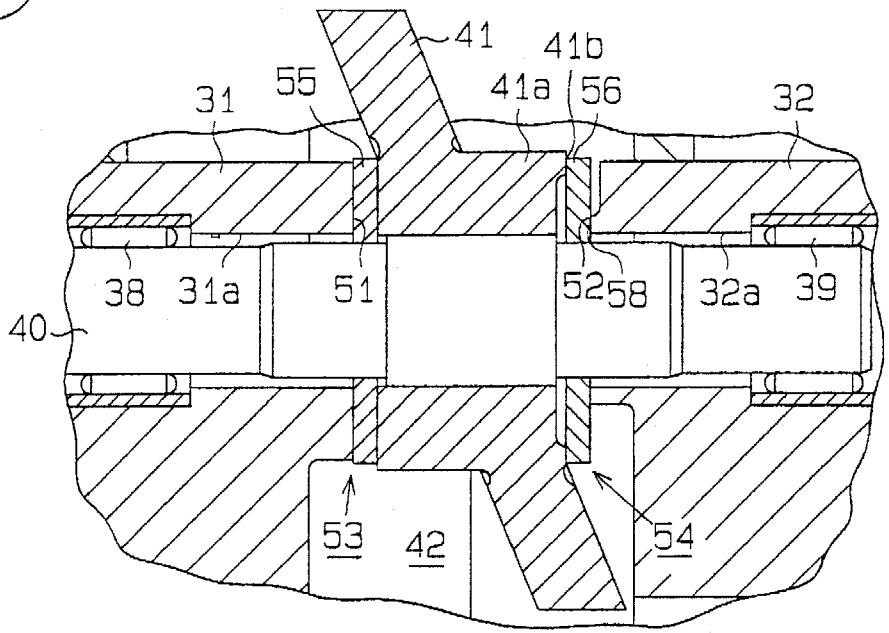
FIG. 5 is a cross-sectional view illustrating a compressor according to a second embodiment of this invention.

The second embodiment of this invention will be now described with reference to FIG. 5.

In this embodiment, the shapes of both seats 51 and 52 are made different from each other and the shapes of both bosses 41*a* are likewise made different from each other to provide a greater effect to absorb the manufacturing tolerances of the individual parts and the vibration caused when the compressor is running.

More specifically, one seat 51 and one boss 41*a* are formed flat and the entire surfaces of both portions 41*a* and 51 come into contact with the washer 55, while the other seat 52 has a rib 58 formed on the inner wall and the associated and opposing boss 41*a* has an annular rib 41*b* formed on the outer peripheral portion.

As the entire surfaces of the former seat 51 and boss 41*a* are brought into contact with the washer 55, the washer 55 does not bend when the compressor is in operation. Therefore, the washer 55 supports the swash plate 41 as the thrust bearing having high rigidity. The vibration of the swash plate 41, produced by the yawing or the like, is not transmitted via the drive shaft 40 through the whole compressor and the vibration of the compressor is prevented accordingly. The other seat 52 and boss 41*a* press the washer 56 in between from the opposing directions with one of their points of action upon washer 56 being at the upper portion and the other at the lower portion. Therefore, the washer 56 bends when the compressor is running. This bending absorbs the manufacturing tolerances of the washers 55 and 56, the bosses 41*a* of the swash plate 41, the seats 52 of the cylinder block 32 and the like, which are not in a position to be supervised at the time of manufacture. The rattling during the running of the compressor can be therefore avoided.

In this embodiment, at the time the swash plate 41 yaws, clearances are also formed between the washers 55 and 56 and the associated seats 51 and 52 and the gas containing a oil mist is drawn into the clearances. As a result, an oil film is formed between the seats 51 and 52 to serve as the thrust bearing as per the first embodiment.

Figure 6:
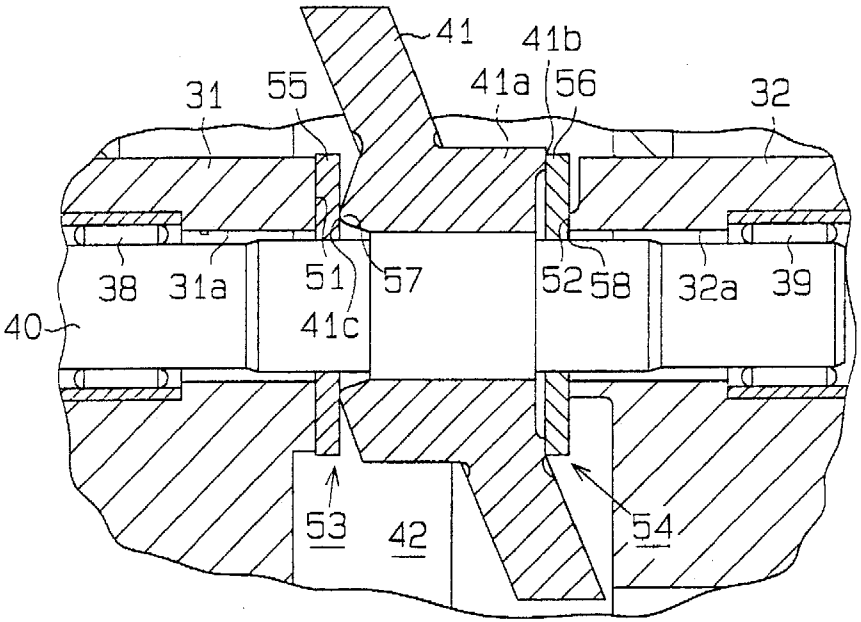
FIG. 6 is a cross-sectional view showing a modification of the second embodiment.

This embodiment may have the structure as shown in FIG. 6. This modification differs from the second embodiment in that an annular projection 41*c* is provided on the inner peripheral portion of one boss 41*a*. With this structure, the washer 55 does not bend and supports the swash plate 41 as the thrust bearing having high rigidity to suppress the vibration when the compressor is in operation, as in the second embodiment.

In addition, the provision of the projection 41*c* on the boss 41*a* produces a large clearance between the boss 41*a* and the washer 55 when the swash plate 41 yaws. The oil film formed by a relatively large amount of lubrication oil entering this clearance performs a large bearing effect.

Figure 7:
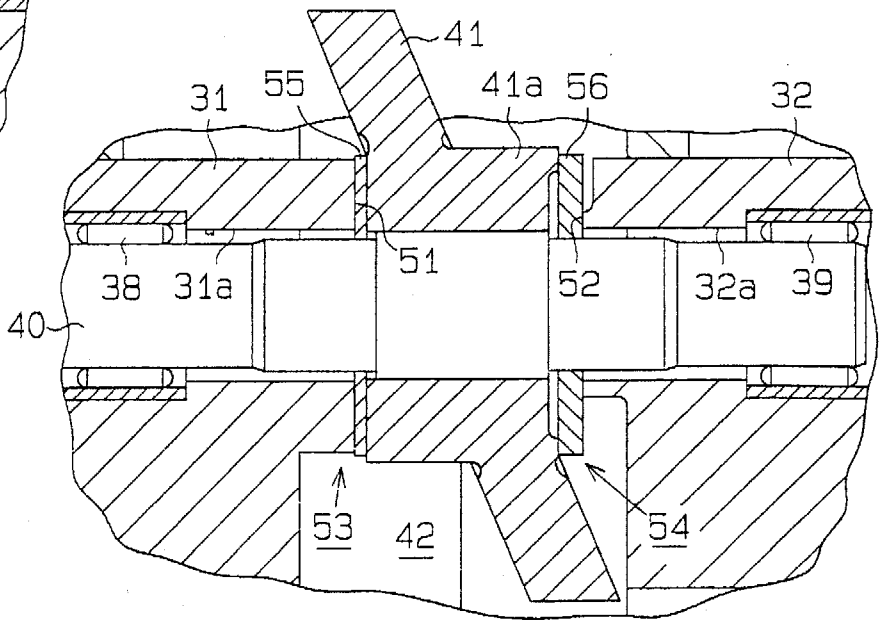
FIG. 7 is a cross-sectional view showing another modification of the second embodiment.

FIG. 7 shows a further modification of the second embodiment. This modification differs from the second embodiment in that one washer 55 is made thinner than the other washer 56. This modification sets different rigidities for the washers 55 and 56 as well as have the advantages of the second embodiment. The front thrust bearing 53 and the rear thrust bearing 54 can be therefore made to have different elastic coefficients. The different thicknesses of the washers 55 and 56 can avoid the resonance thereof to suppress the transmission of the vibration throughout the compressor.

It is desirable that the thicknesses of the washers 55 and 56 are in the ratio of about 1:2 to 1:4. Since the elasticity or rigidity of a flat member is generally proportional to the cube of the thickness, the ratio of the elastic coefficient of the washer 55 to that of the washer 56 based on the aforementioned thickness ratio becomes about 1:8 to 1:64.

In FIG. 7, the washer 56 forming one thrust bearing 54 is designed to be elastically deformable and to be thicker than the washer 55 forming the other thrust bearing 53. The both sides of the washer 55 forming the thrust bearing 53 contact substantially the entire surfaces of the boss 41*a* and the seat 51. In this case, the balanced rigidity of the whole compressor can become more stable, thus further suppressing the vibration of the compressor. The structures of the thrust bearings 53 and 54 may be reversed with respect to the bosses 41*a*.

The following approaches may also be available to make the elastic coefficients of the front and rear thrust bearings 53 and 54 different from each other.

(A) With the washers 55 and 56 designed to have the same thickness, the seats 51 and 52 are designed to have different diameters. That is, the elastic coefficients of both thrust bearings 53 and 54 are made different from each other by changing the diameters of the members that support both washers 55 and 56.

(B) Washers 55 and 56 with different diameters may be used and the bosses 41*a* of the swash plate 41 and the seats 51 and 52 of the cylinder blocks 31 and 32 may be formed at the proper positions to hold the washers 55 and 56.

A description will be now given of various other examples different in viewpoints from the first and second embodiments.

Figure 9:
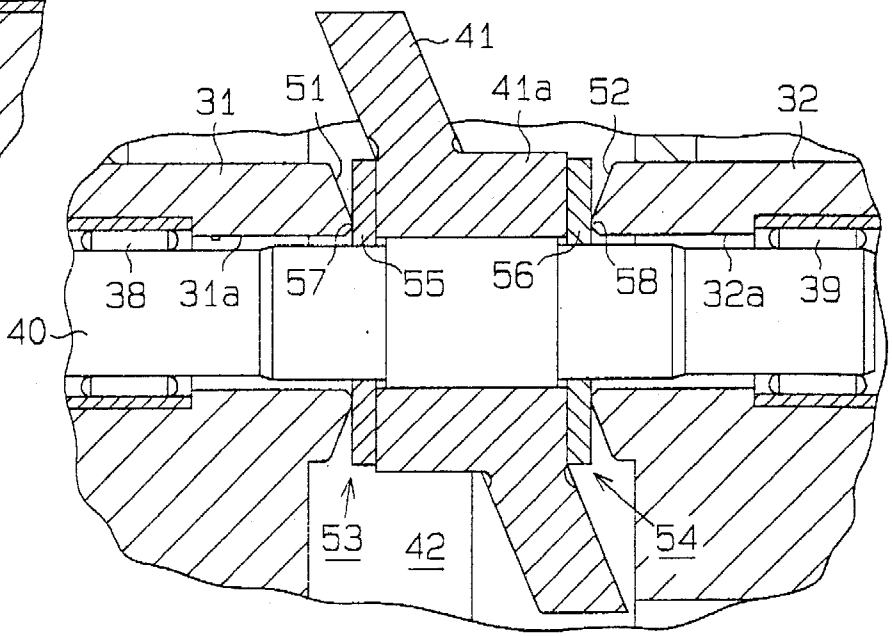
FIG. 9 is a cross-sectional view showing a further example of the pressure-receiving portion.
Figure 8:
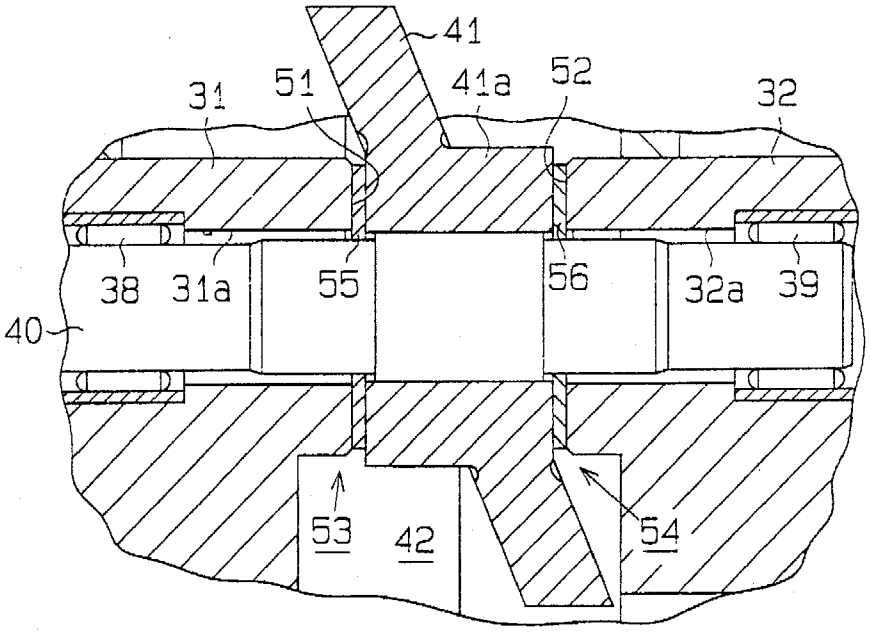
FIG. 8 is a cross-sectional view showing another example of the pressure-receiving portion.

FIGS. 8 and 9 show different examples of the pressure-receiving portions 51 and 52.

In FIG. 8, the bosses 41*a* of the swash plate 41 and the seats 51 and 52 of the cylinder blocks 31 and 32 are made flat to match the entire surfaces of one sides of the washers 55 and 56. This structure requires no special working on the pressure-receiving portions 51 and 52, thus making the manufacturing of the compressor easier. In this example, the bosses 41*a* are arranged approximately in parallel to the seats 51 and 52. Even when the moment load originated from the reaction force acts on the cylinder blocks 31 and 32, it is possible to effectively prevent the load from being locally concentrated on the washers 55 and 56.

In this example too, slight wedge-like clearances are formed between each washer 55 or 56 and the associated seat 51 or 52 and the associated boss 41*a* to form a lubrication-oil passage as in the above-described embodiments. Therefore, this example exhibits the effect of the thrust bearing formed by the oil film. It is to be noted that this example have all the advantages of the first embodiment.

FIG. 9 shows annular projections 57 and 58 formed closer to the inner peripheral portions of the seats 51 and 52. In this example, the clearances between the washers 55 and 56 and the associated seats 51 and 52 near side can be set larger. The oil films formed in those clearances become thicker accordingly, thus improving the bearing function.

Figure 11:
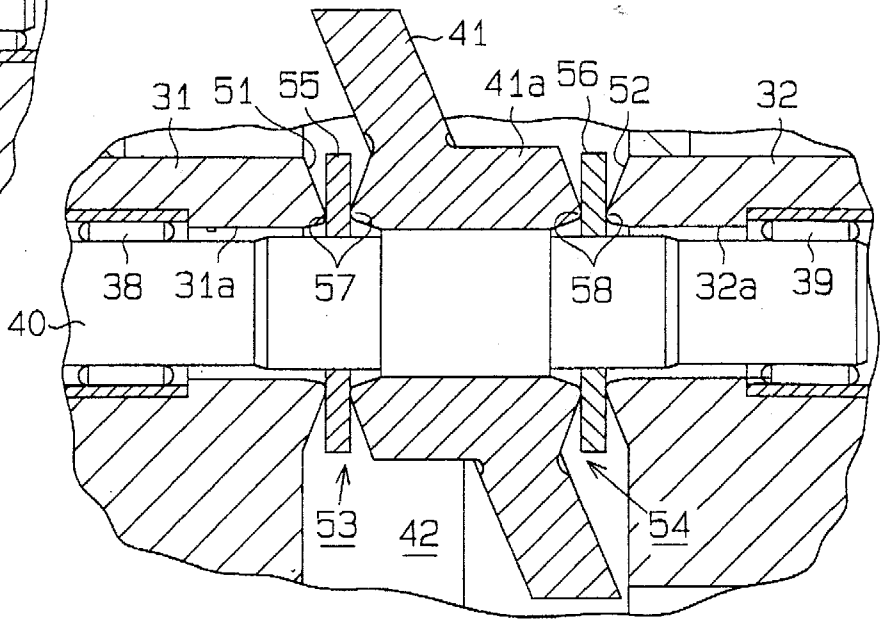
FIG. 11 is a cross-sectional view showing a second modification of annular projections likewise formed on both of the seat and boss.
Figure 10:
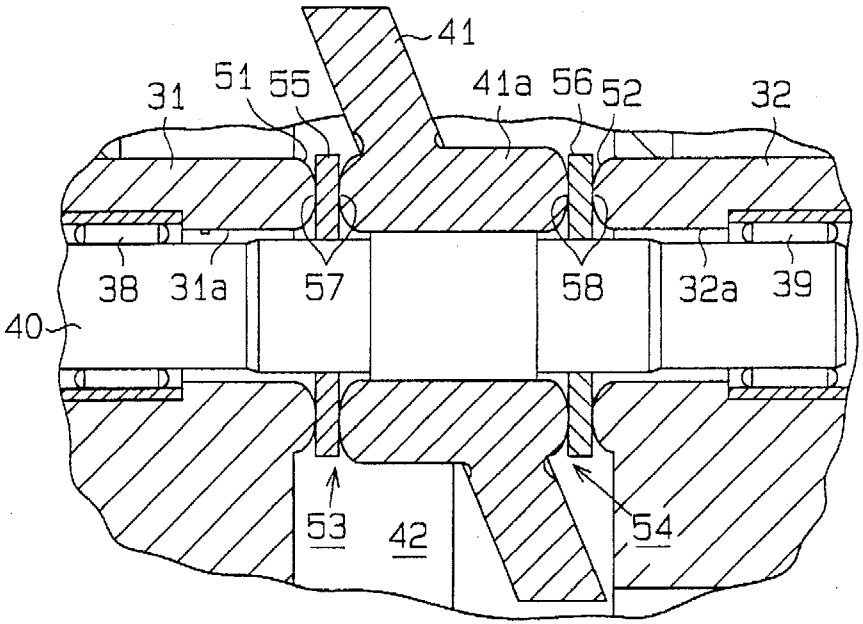
FIG. 10 is a cross-sectional view showing a first modification of annular projections formed on both of the seat and boss.
Figure 12:
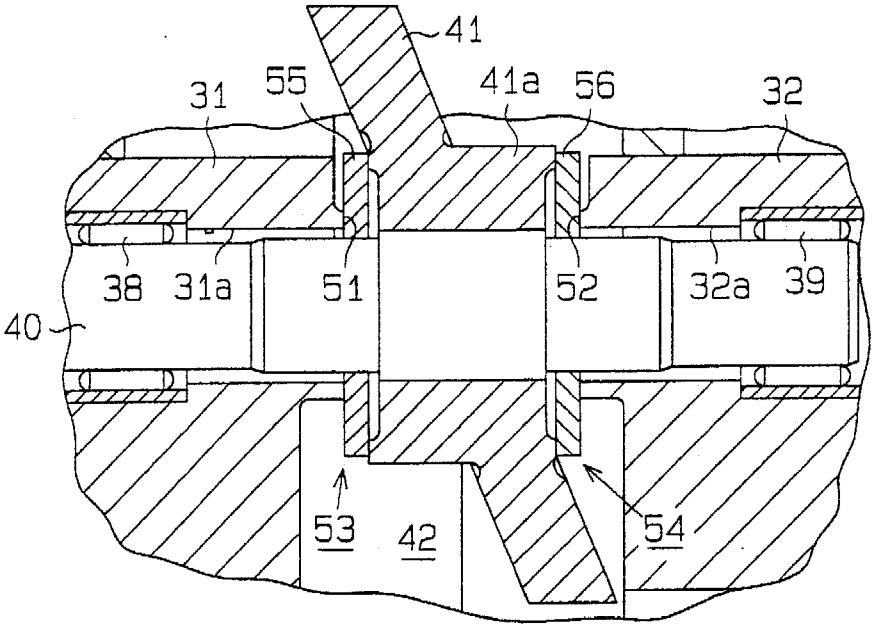
FIG. 12 is a cross-sectional view showing a further modification of annular projections formed on both of the seat and boss.

FIGS. 10 to 12 show further examples in which annular ribs 57 and 58 are formed on both the seats 51 and 52 of the cylinder blocks 31 and 32 and the bosses 41*a*.

In FIG. 10, semi-arcuate annular ribs 57 and 58 are formed on the seats 51 and 52 and the bosses 41*a*. In this example, the ribs 57 and 58 do not have sharp cross-sectional shapes so that the wear-out of the bosses 41*a*, the washers 55 and 56 and the ribs 51 and 52 is reduced, thus extending the lives of the individual components. This example also has the advantage of forcibly supplying the lubrication oil mist in the spaces formed between the ribs 57 and 58 and the washer 56 based on the yawing of the swash plate 41.

The example in FIG. 11 has the ribs 57 and 58 formed on both the seats 51 and 52 and the bosses 41*a* closer to their inner peripheral portions, and bring about the same advantages as the modification shown in FIG. 6.

FIG. 12 shows the example in which the diameters of the seats 51 and 52 are made smaller than those of the washers 55 and 56, and the diameters of the bosses 41*a* are made greater than those of the washers 55 and 56. In this case, the area of each boss 41*a* contacting the associated washer becomes greater than the area of each seat 51 or 52 contacting the associated washer. Therefore, sliding occurring between the seats 51 and 52 and the associated washers 55 and 56 becomes larger. This example also forms the oil films in the clearances formed between the seats 51 and 52 and the washers 55 and 56 based on the yawing of the swash plate 41 caused by the reaction force. Those washers 55 and 56 and the oil films serve as the dynamic bearings.

In this modification, the dimensional tolerances of the individual components is effectively absorbed by the elastic deformation on the washers 55 and 56. It is therefore easy to assemble the individual components and to manage the dimensions of the individual components at the time of production.

Figure 13:
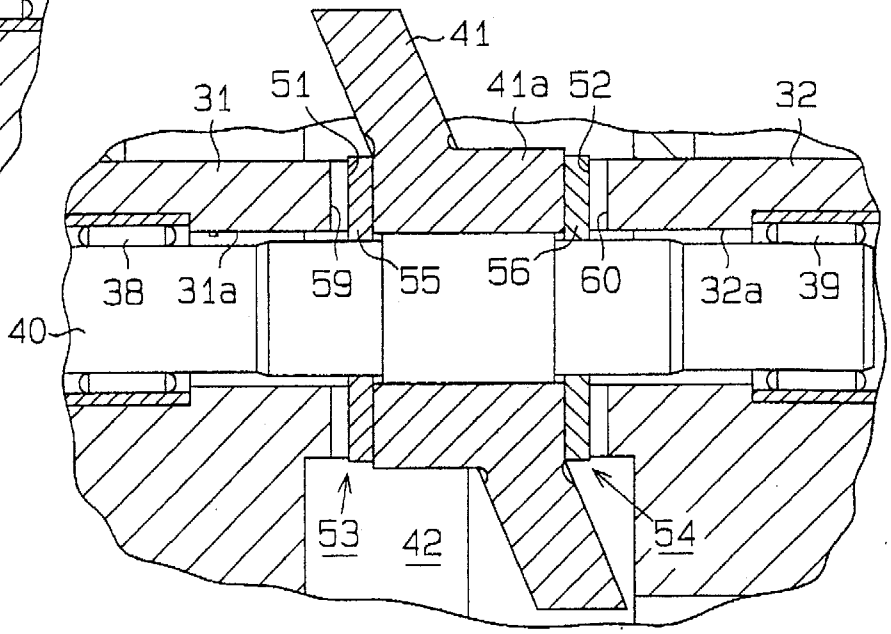
FIG. 13 is a cross-sectional view showing another example wherein a passage for a lubrication oil is provided at the seat.
Figure 14:
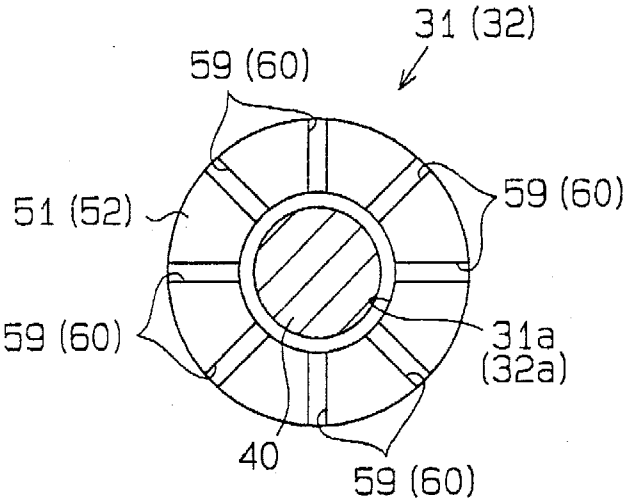
FIG. 14 is a side view of the seat shown in FIG. 13.

FIGS. 13 and 14 show another modification to form the dynamic thrust bearing using an oil film.

As shown in FIG. 13, lubrication-oil passages 59 and 60 communicating with the crank chamber 42 are provided on the seats 51 and 52. FIG. 14 is a side view of the seats 51 and 52 as viewed from the bosses 41*a*. The passages 59 and 60 may be formed to communicate with the center holes 31*a* and 32*a*.

The passages 59 and 60 further facilitate the formation of the oil films between the washers 55 and 56 and the associated seats 51 and 52. Further, the use of the passages 59 and 60 facilitates the lubrication of the radial bearings 38 and 39.

Because, as shown in FIG. 14, the surface of each seat 51 or 52 is divided to a plurality of surfaces (eight surfaces in diagram) by the associated passage 59 or 60, the rigidity of the seats 51 and 52 can be reduced. Therefore, the production errors of the swash plate 41, the cylinder blocks 31 and 32, the washers 55 and 56 and so forth can be easily absorbed during the running of the compressor by the elastic deformation occurring near the surfaces of the seats 51 and 52, i.e., near the passages 59 and 60. This effectively suppresses the vibration at the time the compressor starts running.

It is desirable that the surface of each seat 51 or 52 be divided to at least three surfaces. When the swash plate 41 yaws, the bosses 41*a* move on the surfaces of the seats 51 and 52. If the surface of each seat 51 or 52 is segmented to three or more surfaces, therefore, the yawing-originated moment load, wherever acting, is absorbed by the elastic deformation in the vicinity of the surface of the seat 51 or 52.

Figure 15:
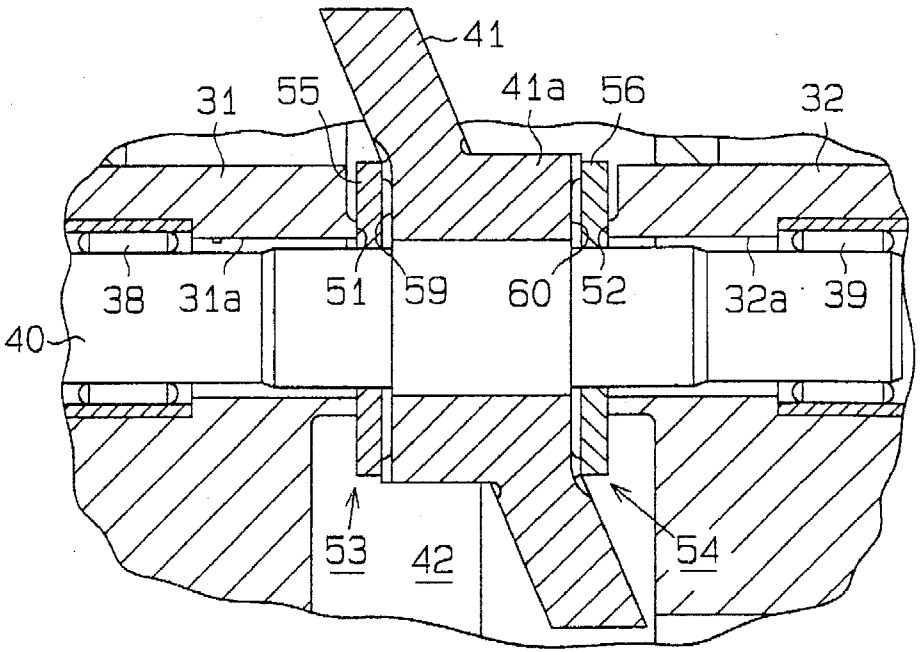
FIG. 15 is a cross-sectional view showing a different example wherein a passage is provided at the boss.
Figure 16:
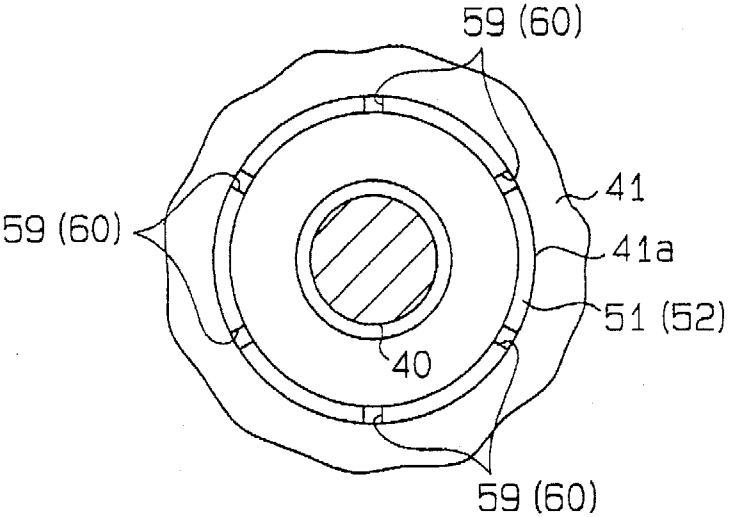
FIG. 16 is a side view of the boss shown in FIG. 15.

FIGS. 15 and 16 show a different example in which the oil passages 59 and 60 which communicate with the crank chamber 42 are formed on the bosses 41*a*. The washers 55 and 56 are held in an elastically deformable manner by the same structure as employed in the example illustrated in FIG. 12. This structure can facilitate the formation of the oil film between the washer 55 and the associated boss 41*a*.

Figure 17:
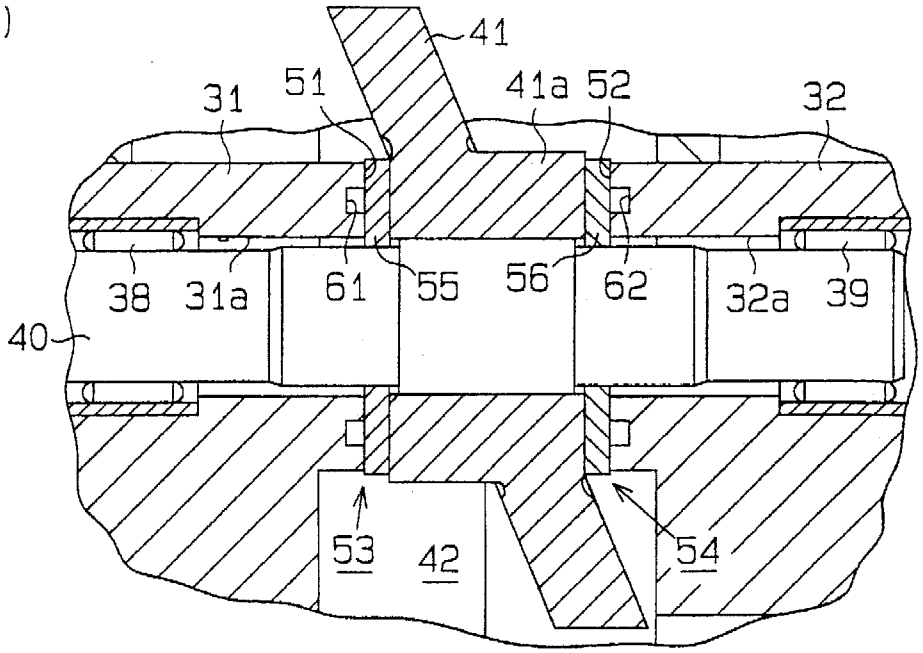
FIG. 17 is a side view showing a further example wherein a groove for retaining a lubrication oil is provided at the seat.
Figure 18:
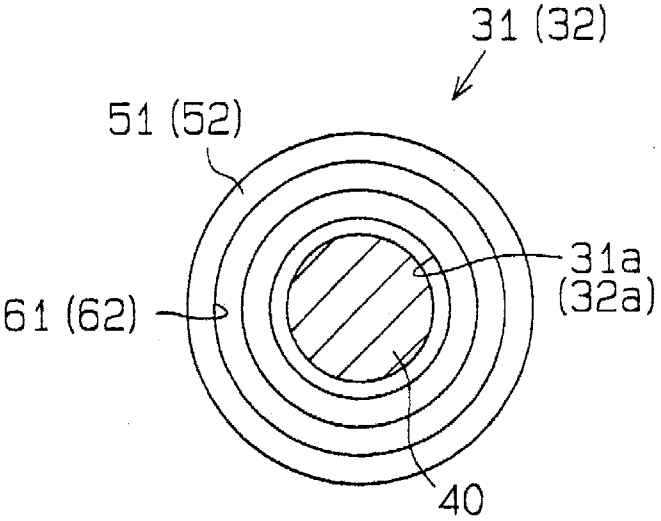
FIG. 18 is a side view of the seat shown in FIG. 17.
Figure 21:
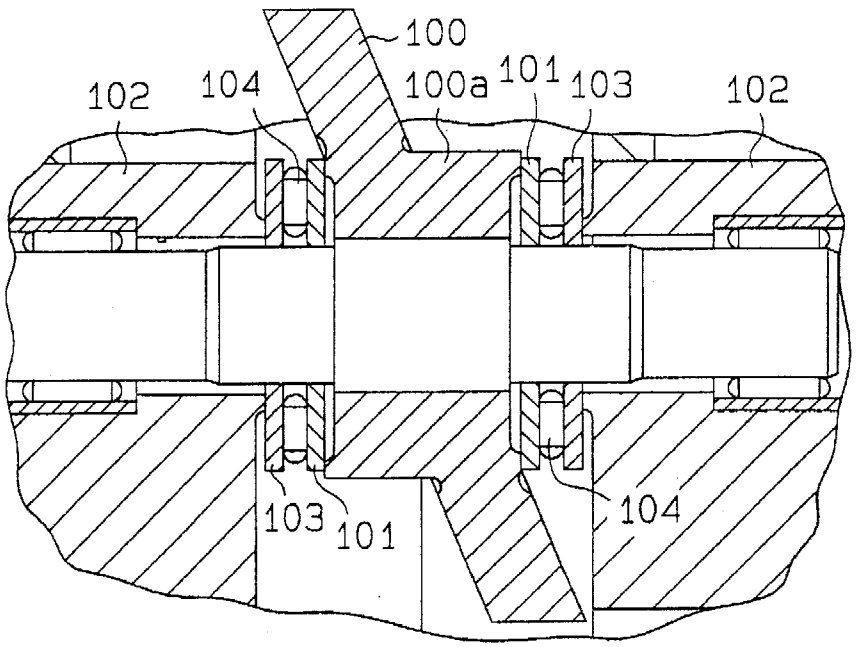
Fig.21 (PRIOR ART)
FIG. 21 is a cross-sectional view showing the conventional thrust bearing of the rotary shaft.

FIGS. 17 and 18 show the bearing mechanism that has lubrication-oil retaining grooves 61 and 62 formed at the middle positions of the outer and inner peripheral edges of the seats 51 and 52. Those grooves 61 and 62 run on the entire surfaces of the seats 51 and 52. When the washers 55 and 56 deform in accordance with the yawing of the swash plate 41, minute clearances are formed between the washers 55 and 56 and the associated seats 51 and 52. The refrigerant gas entering those clearances reach inside the grooves 61 and 62. It is therefore possible to easily form the oil films between the washers 55 and 56 and the associated seats 51 and 52.

The oil grooves 61 and 62 may be formed in the bosses 41*a* of the swash plate 41.

Figure 19:
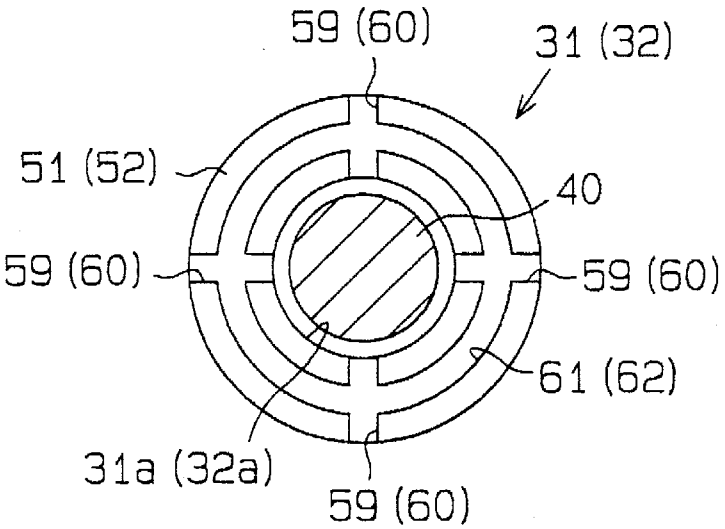
FIG. 19 is a side view of the seat illustrating a first modification wherein the passage and the retaining groove are both provided.
Figure 20:
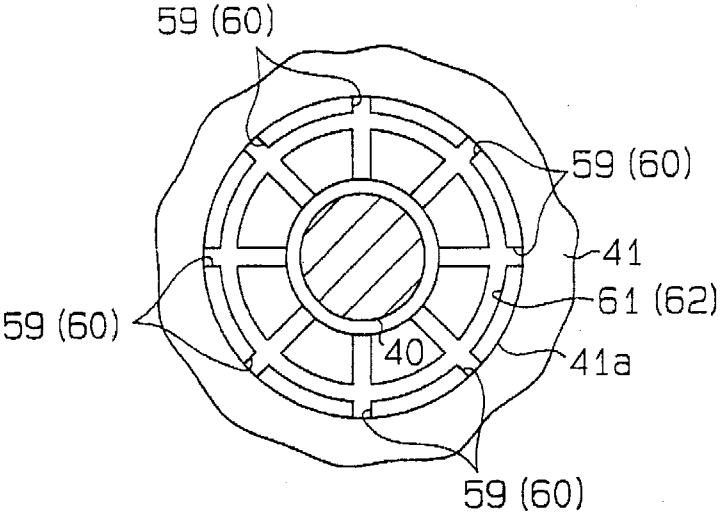
FIG. 20 is a side view of the seat illustrating a second modification wherein the passage and the retaining groove are both provided.

FIG. 19 shows the bearing mechanism which has both the lubrication oil passages 59 and 60 and the retaining grooves 61 and 62 at the respective seats 51 and 52. In this structure, the oil films can be formed very effectively by the synergistic effect of the passages 59 and 60 and the grooves 61 and 62. The passages 59 and 60 and the grooves 61 and 62 may be formed at the bosses 41*a* as shown in FIG. 20.

Although this invention is embodied in a swash plate type compressor in the above-described embodiments and examples, this invention may be embodied in a wave cam type compressor in which each piston reciprocates multiple times as the drive shaft rotates once.

In this case, in view of only one thrust bearing 53, the moment load produced by the compressive reaction force acts on the thrust bearing 53 multiple times as the drive shaft makes one turn. It is therefore possible to increase the number of times the lubrication oil mist is introduced between the washer 55 and the seat 51 as compared with the swash plate type compressor. This approach can prevent the progression of the frictional wearing by the direct contact between the cylinder block 31 and the washer 55.

What is claimed is:

1. A compressor including a pair of cylinder blocks having a crank chamber therebetween, each of the cylinder blocks having at least one cylinder bore located in opposition to a bore in the other cylinder block and passing completely through the cylinder block in the axial direction and having an outer end surface closed by a housing attached to the end surface to define a suction chamber and a discharge chamber, said crank chamber accommodating a cam plate mounted on a rotary shaft, wherein said cam plate converts a rotation of the rotary shaft to a reciprocating movement of a double-headed piston in the opposed cylinder bores to compress gas containing a lubricant oil mist supplied to the cylinder bores from the suction chamber and discharge the compressed gas from the discharge chamber, said compressor being characterized in that:

said cam plate has a pair of opposite surfaces;

a pair of bosses are formed respectively in said surfaces of the cam plate;

a pair of annular seats are formed respectively in said cylinder blocks opposed one to each of said bosses;

a pair of ring washers are clamped respectively by the bosses and the seats to receive thrust load acting on the rotary shaft;

each cylinder block and the associated housing define said discharge chamber corresponding to the central region of the cylinder block; and means are provided for forming an oil film with accumulated oil mist, said means for forming an oil film including an annular rib formed on at least one of said bosses and associated seats for creating a space between the boss and the seat during rotation of the rotary shaft.

2. The compressor as set forth in claim 1, wherein said rib is formed close to the inner circumference of the seat.

3. The compressor as set forth in claim 1, wherein said rib is semicircular in a cross section.

4. The compressor as set forth in claim 1, wherein said means for forming an oil film includes a passage for the lubricant oil, said passage being formed in at least one of said boss and said associated seat.

5. The compressor as set forth in claim 4, wherein said passage communicates with the crank chamber.

6. The compressor as set forth in claim 5, wherein said seat is divided into three sections by said passage.

7. A compressor including a pair of cylinder blocks having a crank chamber therebetween, each of the cylinder blocks having at least one cylinder bore located in opposition to a bore in the other cylinder block and passing completely through the cylinder block in the axial direction and having an outer end surface closed by a housing attached to the end surface to define a suction chamber and a discharge chamber, said crank chamber accommodating a cam plate mounted on a rotary shaft, wherein said cam plate converts a rotation of the rotary shaft to a reciprocating movement of a double-headed piston in the opposed cylinder bores to compress gas containing lubricant oil mist and supplied to the cylinder bores from the suction chamber and discharge the compressed gas from the discharge chamber, said compressor being characterized in that:

each said cylinder block and said associated housing define said discharge chamber corresponding to the central region of the cylinder block;

said cam plate has a pair of opposite surfaces;

a pair of bosses are formed respectively in said surfaces of the cam plate;

a pair of annular seats are formed respectively in said cylinder blocks opposed one to each of said bosses;

a pair of annular washers are clamped respectively by the bosses and the seats to receive thrust load acting on the rotary shaft; and means are provided for forming an oil film with accumulated oil mist between each of said bosses and the respective associated seat.

8. The compressor as set forth in claim 7, wherein said means for forming an oil film includes an annular rib formed on at least one of the boss and the associated seat for creating a space between the boss and the seat during rotation of the rotary shaft.

9. The compressor as set forth in claim 8, wherein said rib includes a passage for said lubricant oil, said passage being formed in at least one of the boss and the associated seat, said passage communicating with the crank chamber.

10. The compressor as set forth in claim 9, wherein said seat is divided into three sections by said passage.

11. A compressor, used in a vehicle, including a pair of cylinder blocks having a crank chamber therebetween, each of the cylinder blocks having a cylinder bore passing completely through the cylinder block in the axial direction and an outer end surface closed by a housing attached to the end surface to define a suction chamber and a discharge chamber, said crank chamber accommodating a cam plate mounted on a rotary shaft, wherein said cam plate converts a rotation of the rotary shaft to a reciprocating movement of a double-headed piston in the cylinder bores to compress gas containing lubricant oil mist and supplied to the cylinder bores from the suction chamber and discharge the compressed gas from the discharge chamber, said compressor comprising:

each cylinder block and the associated housing defining the discharge chamber corresponding to the central region of the cylinder block;

said cam plate having a pair of surfaces;

a pair of bosses respectively formed in said surfaces of the cam plate;

a pair of annular seats respectively formed in said cylinder blocks and opposed to the bosses;

a pair of annular washers respectively clamped by the bosses and the seats to receive thrust load acting on the rotary shaft;

means for forming an oil film with the accumulated oil mist, said film forming means including an annuler rib formed at least on one of each bosses and the associated seat to create a space in accordance with the rotation of the rotary shaft, wherein said space introduces the oil mist thereinto.

12. The compressor as set forth in claim 11, wherein said rib includes a passage for lubricant oil, said passage being formed in at least one of the boss and the associated seat, wherein said rib creates a space between the boss and the seat during rotation of the rotary shaft, and wherein said seat is divided into three sections by said passage.

13. A compressor including a pair of cylinder blocks having a crank chamber therebetween, each of the cylinder blocks having a cylinder bore passing completely through the cylinder block in the axial direction and an outer end surface closed by a housing attached to the end surface to define a suction chamber and a discharge chamber, said crank chamber accommodating a cam plate mounted on a rotary shaft, wherein said cam plate converts a rotation of the rotary shaft to a reciprocating movement of a double-headed piston in the cylinder bores to compress gas supplied to the cylinder bores from the suction chamber and discharge the compressed gas from the discharge chamber, said compressor comprising:

said cam plate having a first surface and a second surface opposed to the first surface;

a first boss and a second boss respectively formed in the first surface and the second surface of the cam plate;

a first annular seat and a second annular seat respectively formed in the cylinder blocks and opposed to the first boss and the second boss;

a first ring washer clamped by the first boss and the first seat to receive thrust load acting on the rotary shaft;

a second ring washer clamped by the second boss and the second seat to receive thrust load acting on the rotary shaft; and the first washer being solidly clamped; and the second ring washer being elastically and bendably clamped.

14. The compressor as set forth in claim 13 further comprising:

a plane formed in the first seat;

a first rib formed in the second seat;

the first washer being solidly clamped by the plane and the first boss;

a second rib extending in a circumferential direction in the second boss, said second rib having a different radius from the first rib; and said second washer being flexibly clamped by the first rib and the second rib.

15. The compressor as set forth in claim 14 further comprising a second plane formed in the first boss.

16. The compressor as set forth in claim 14 further comprising a third rib formed in the first boss.

17. The compressor as set forth in claim 13, wherein said first washer occupies a different thickness from said second washer.

18. The compressor as set forth in claim 14, wherein each cylinder block and the associated housing define a discharge chamber within the central region of the cylinder block.

19. The compressor as set forth in claim 18 further comprising:

said gas containing lubricant oil mist; and means for forming an oil film with the accumulated oil mist, said means being formed at least one of each bosses and the associated seat.

20. The compressor as set forth in claim 19, wherein said film forming means includes one of the ribs formed on at least one of the bosses and one of the ribs formed on the associated seat, wherein said ribs create a space between the boss and the seat based on the rotation of the rotary shaft.

* * * * *